US005709117A

United States Patent [19]

George

[11] Patent Number: 5,709,117

[45] Date of Patent: Jan. 20, 1998

[54] COLLET ASSEMBLY FOR BENDING APPARATUS

[75] Inventor: Philip George, Ivybridge, England

[73] Assignee: Eurobend Limited, Ivybridge, England

[21] Appl. No.: 684,769

[22] Filed: Jun. 28, 1996

[30] Foreign Application Priority Data

Jul. 5, 1995 [GB] United Kingdom ..... 9513689

[51] Int. Cl.[6] ..... B21D 7/04; B21D 9/05

[52] U.S. Cl. ..... 72/149; 279/106; 72/419; 72/420

[58] Field of Search ..... 72/149, 420, 419, 72/293, 159, 156; 279/106, 108, 35, 37

[56] References Cited

U.S. PATENT DOCUMENTS

| | | | |
|---|---|---|---|
| 1,783,420 | 12/1930 | Garno | 279/106 |
| 1,812,006 | 6/1931 | Jellicoe | 279/106 |
| 3,974,676 | 8/1976 | Eaton | 72/419 |
| 4,848,120 | 7/1989 | Schwarze | 72/149 |
| 4,893,982 | 1/1990 | Yamaguchi . | |
| 4,924,738 | 5/1990 | Che | 279/106 |

FOREIGN PATENT DOCUMENTS 1414027 11/1975 United Kingdom .

*Primary Examiner*—Lowell A. Larson
*Assistant Examiner*—Rodney A. Butler
*Attorney, Agent, or Firm*—Davis and Bujold

[57] ABSTRACT

A collet assembly for a bending apparatus has a support ring the support ring being connected coaxially to a tubular support member, five jaws being pivotally connected to the free end of the support ring by means of parallelogram linkages, each of the parallel linkages having a pair of links one disposed radially inwardly of the other to permit movement of the jaws transverse to the axis of the support rings, the jaws being spaced angularly around the circumference of the support ring; an actuating assembly has an outer ring connected to a control sleeve slidably mounted on the tubular support member and an inner ring disposed on the internal diameter of the support ring, the inner ring defines a cam formation for engagement with corresponding formations on the inner link of each parallelogram linkage, the inner ring of the actuating assembly being connected to the outer ring through elongate slots in the support ring, so that the actuating assembly may be moved axially with respect to the support ring between a position in which the jaws clamp the outer surface of an elongate workpiece and a position in which the jaws are released from the outer surface of the elongate workpiece.

16 Claims, 3 Drawing Sheets

COLLET ASSEMBLY FOR BENDING APPARATUS

BACKGROUND TO THE INVENTION

The present invention relates to a collet assembly for a bending apparatus and in particular to a bending apparatus in which an elongate workpiece is progressively advanced through a bending head, so that bends may be formed along the length of the workpiece in one or more dimensions.

Conventionally the workpiece, for example a tube, is clamped in a collet assembly having a plurality of jaws which are adapted to engage the external surface of the workpiece. The collet assembly may then be advanced linearly to move the tube through the bending head, and rotated to change the orientation of the bends produced in the workpiece.

Hitherto, the collet assembly used to clamp the tube has been of fixed size, permitting the clamping of a workpiece of fixed cross-sectional dimensions. The jaws of the collet assembly being selectively movable between a clamping position in which they will clampingly engage the surface of appropriate cross-sectional dimensions and a released position in which the jaws are removed from the surface of the elongate workpiece. When it is desired to bend the workpiece of different cross-sectional dimensions, it has hitherto been necessary to replace the collet assembly.

The present invention provides a universal collet assembly for a bending apparatus in which the jaws can be adjusted to clamp elongate workpieces of different cross-sectional dimensions.

SUMMARY OF THE INVENTION

According to one aspect of the present invention, a collet assembly for a bending apparatus comprises a support ring, the support ring being adapted at one end to be connected coaxially to a tubular support member, a plurality of jaws being pivotally connected to the other end of the support ring by means of parallelogram linkages, the parallelogram linkages having a pair of links one disposed radially inwardly of the other, to permit movement of the jaws transverse to the axis of the support ring, the jaws being spaced angularly around the circumference of the support ring; an actuating assembly being mounted coaxially of the support ring, the actuating assembly comprising an outer ring adapted to be connected to a control sleeve slidably mounted on the tubular support member and an inner ring disposed on the internal diameter of the support ring, the inner ring defining a cam formation for engagement of a corresponding formation on the inner link of each parallelogram linkage, the inner ring of the actuating assembly being connected to the outer ring through elongate slots in the support ring, so that the actuating assembly may be moved axially with respect to the support ring between a position in which the jaws clamp the outer surface of an elongate workpiece and a position in which the jaws are released from the outer surface of the elongate workpiece.

In accordance with the present invention, by suitable axial adjustment of the actuating mechanism relative to the support ring, the jaws may be arranged to clamp workpieces of different cross-sectional dimensions. Movement of the actuating assembly relative to the support ring is controlled by means of the control sleeve, which is moved axially of the tubular support member by suitable driving means, for example a double acting hydraulic or pneumatic ram. The clamping force applied by the jaws to the workpiece will depend upon the load applied by the driving means.

According to a preferred embodiment of the invention, a roller is provided on the inner link of each parallelogram linkage for engagement of the cam formation on the inner ring of the actuating assembly. Also, a return spring may be provided to retract each of the jaws away from the workpiece, when the clamping load is released.

BRIEF DESCRIPTION OF THE DRAWINGS

An embodiment of the invention is now described, by way of example only, with reference to the accompanying drawings in which.

DESCRIPTION OF A PREFERRED EMBODIMENT

Figure 1:
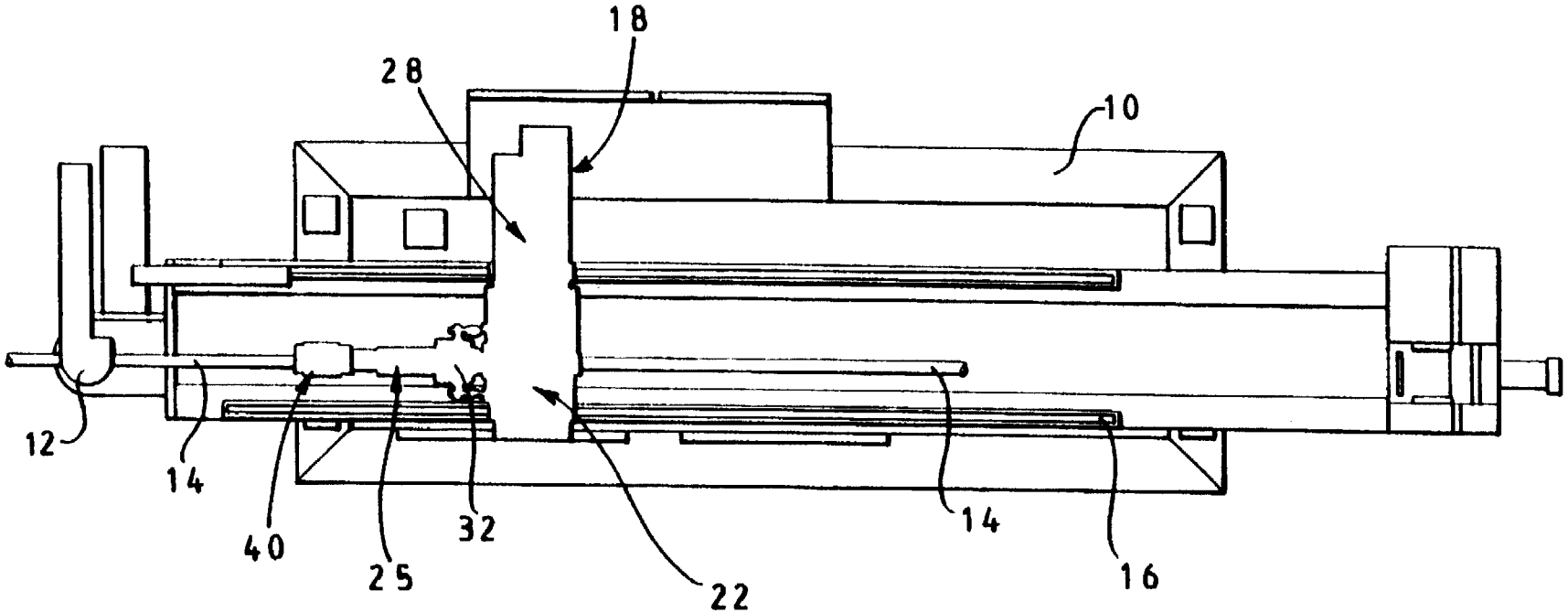
FIG. 1 shows a plan view of a tube bending machine with a collet assembly in accordance with the present invention.

As illustrated in the accompanying drawings, a tube bending machine includes a bed 10 with bending head 12 at one end. The bending head 12 comprises a pair of dies which may be clamped about a tube 14 in a horizontal plane, one die being rotatable about the other so that a bend may be formed in the tube 14.

A slide 16 is provided on the machine bed 10 and a carriage 18 is mounted upon the slide 16 for linear movement towards and away from the bending head 12. A cross-slide 20 is provided on the carriage 18 and a carriage 22 is mounted on the cross-slide 20 for movement transverse to the direction of movement of carriage 18. Drive means (not shown) are provided for movement of carriages 18 and 22.

Figure 2:
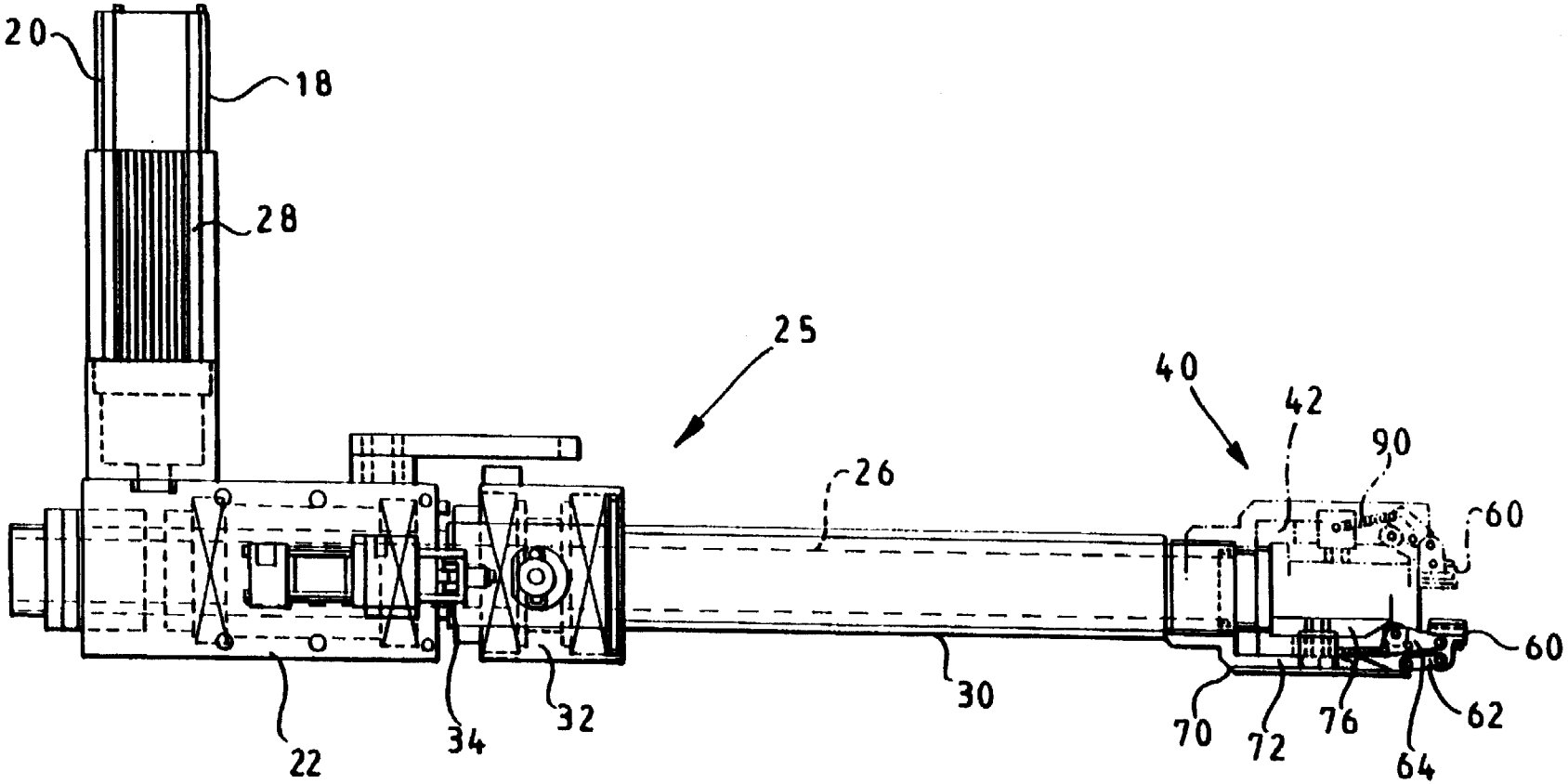
FIG. 2 is a plan view of the workpiece clamping assembly of the bending machine illustrated in FIG. 1.

A tube clamping assembly 25 as illustrated in FIG. 2, comprises a tubular support member 26, which is secured to the carriage 22, so that it extends parallel to the direction of movement of the carriage 18. The tubular support 26 is fixed axially with respect to the carriage 22 but is rotatable about its own axis by means of a motor 28.

A control sleeve 30 is mounted coaxially of the tubular support member 26. A double acting ram assembly 32 is also mounted coaxially of the tubular support member 26 and acts between a stop 34 fixed axially with respect to the carriage 22 and one end of the control sleeve 30. The control sleeve 30 may be moved axially with respect to the tubular support member 26 by means of the ram 32.

A collet assembly 40 is secured to the tubular support member 26 at the end adjacent the bending head 12.

Figure 4:
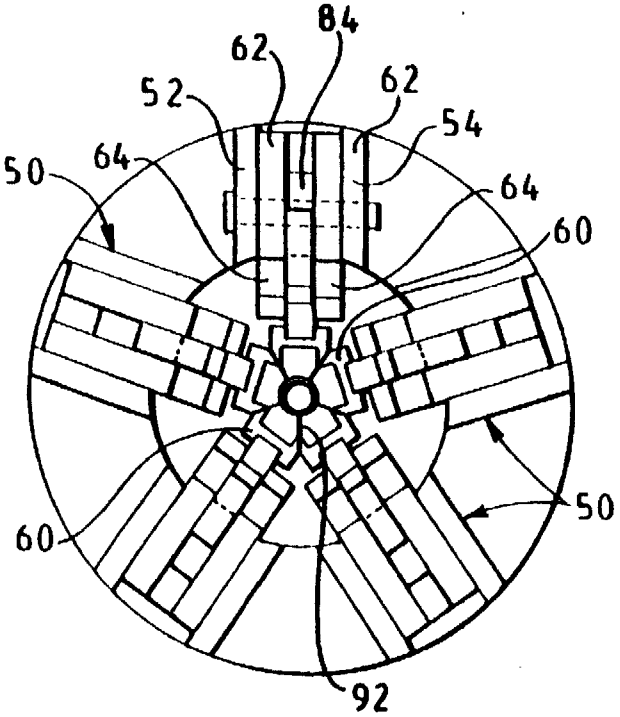
FIG. 4 is an end elevation of the collet assembly illustrated in FIG. 3.
Figure 3:
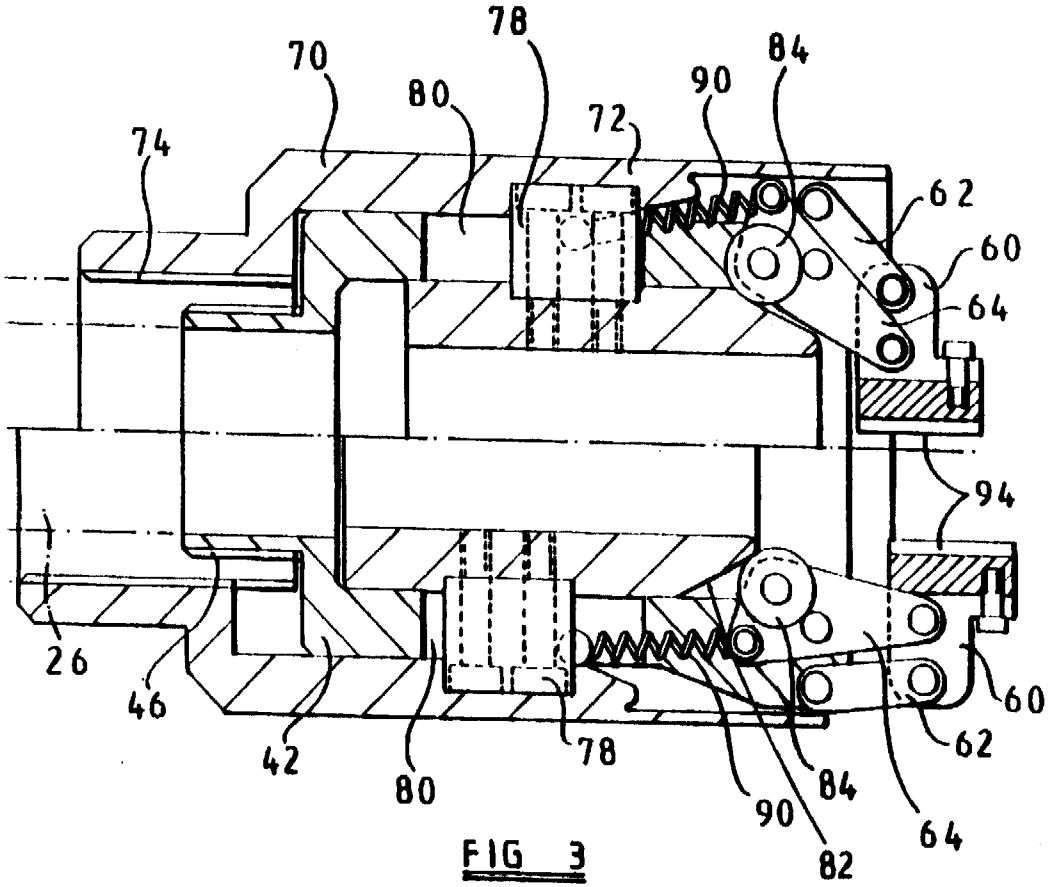
FIG. 3 is a sectional side elevation of a collet assembly in accordance with the present invention.

As illustrated in FIGS. 3 and 4, the collet assembly 40 comprises an inner support ring 42, one end of which has a screw thread formation 46 by which it may be secured coaxially to the end of the tubular support member 26 by means of a corresponding screw thread formation.

The other end of the support ring 42 defines five axially extending bifurcated bracket formations 50. The bracket formations 50 are equiangularly spaced around the support ring 42.

A jaw 60 is connected to each bracket formation 50 by means of two pairs of links 62, 64, the pairs of links 62 and 64 being pivotally connected to the jaw 60 and between the limbs 52, 54 of the bracket formations 50, to provide a parallelogram linkage. Links 62 are located radially outwardly of links 64 so that the parallelogram linkage will permit the jaw 60 to move transversely of the axis of the support ring 42.

An actuator assembly 70 comprises an outer ring 72 which is mounted coaxially outside the support ring 42. One end of the outer ring 72 has a screw thread formation 74 by which it is attached to the end of the control sleeve 30. An inner ring 76 mounted coaxially of the support ring 42 on the internal diameter thereof, is secured to the outer ring 72 by a plurality of angularly spaced blocks 78 which extend through elongate apertures 80 in the support ring 42. The inner and outer rings 76, 72 may thus be moved axially relative to the support ring 42, by means of the control sleeve 30.

The end of inner ring 76 adjacent the jaws 60 has a chamfer formation 82 on its external diameter. A roller 84 is provided on the inner link 64 of each parallelogram linkage, for engagement of the chamfer formation 82 on the inner ring 76. The roller 84 is pivotally connected to an extension of the link 64 on the side of its pivotal connection to the support ring 42 remote from its pivotal connection to the jaw 60, so that as the roller 84 moves along the chamfer formation 82 from the smaller diameter end to the larger diameter end, link 64 will he pivoted about its pivoted connection to the support ring 42, to cause the jaw 60 to move inwardly.

A spring 90 is provided between a point on the extension of lever 64 remote from the pivotal connection to the jaw 60 and a point on the support ring 42 for each parallelogram linkage assembly, to bias the rollers 84 into engagement with the chamfer formation 82 on the inner ring 76, so that as the roller 84 moves down the chamfer formation 82 from the larger diameter end to the smaller diameter end, the roller 84 will remain in engagement with the chamfer formation 82 causing the jaw 60 to move outwardly.

The inner faces 94 of the jaws 60 are flat and may be lined with a hard neoprene rubber or other hard resilient composition. The longitudinal inner edges 92 of the jaw 60 are chamfered to enable the jaws 60 to be brought closely together to define the minimum clamping diameter.

In use, the jaws 60 of the collet assembly 40 are opened by moving the control sleeve 30 away from the bending head 12 by means of the hydraulic ram assembly 32. This moves the actuator assembly 70 to the left relative to the support ring 42, as illustrated in the bottom part of FIG. 3, so that the rollers 84 move to the smaller diameter end of the chamfer formation 82 and the springs 90 cause the jaws 60 to open.

A tube 14 may then be located through the collet assembly 40, the tube 14 extending in one direction through the collet assembly 40 towards the bending head 12 and in the other direction through the tubular support member 26.

The tube 14 may then be clamped by the collet assembly 40 by actuating a hydraulic ram assembly 32 to cause the control sleeve 30 to move towards the bending head 12, so that the actuator assembly 70 is moved to the right as illustrated in the upper part of FIG. 3. As the rollers 84 move along the chamfer formation 82 from the smaller diameter end to the larger diameter end, the jaws 60 move inwardly until they engage the tube 14 and apply a clamping force thereon equivalent to the load applied by the hydraulic ram assembly 32.

The portion of the tube 14 extending towards the bending head 12 may then be advanced into the bending head 12 so that it is located at an appropriate position for a bend to be formed, by means of movement of the carriage 18 along the slide 16. Once one bend has been formed in the tube 14, the tube 14 may be further advanced for bending operations at different locations along the length of the tube 14. Bends in different orientations may be formed by rotating the tube 14 by means of motor 28.

When the portion of the tube 14 extending from the collet assembly 40 towards the bending head 12 has been advanced through the bending head 12, more tube may be fed through the collet assembly 40 by opening the jaws 60 and, with the tube 14 clamped between the dies of the bending head 12, reversing the carriage 18 so that the tube 14 is fed through the open jaws 60 of the collet assembly 40. The jaws 60 may then be closed to re-clamp the tube 14 and the new length of tube 14 advanced through the bending head 12, as described above.

When tubes 14 of different diameters are bent using the bending machine described above, the centre of the tube 14 must be adjusted with respect to the dies of the bending head 12. This may be achieved by means of movement of the carriage 22 on the cross-slide 20.

Various modifications may be made without departing from the invention. For example, while a tube bending machine has been described above, the present invention may be used for bending any elongate workpiece, for example solid bars. Also, while the apparatus will normally be used for workpieces of constant cross-sectional dimensions, workpieces of varying cross-sectional dimensions, for example increasing or decreasing diameter, could also be handled.

I claim:

1. A collet assembly for a bending apparatus comprising a support ring, the support ring at one end is connected coaxially to a tubular support member, a plurality of jaws being pivotally connected to the other end of the support ring by means of parallelogram linkages, the parallelogram linkages having a pair of links one disposed radially inwardly of the other, to permit movement of the jaws transverse to the axis of the support ring, the jaws being spaced angularly around the circumference of the support ring; an actuating assembly being mounted coaxially of the support ring, the actuating assembly comprising an outer ring connected to a control sleeve slidably mounted on the tubular support member and an inner ring disposed on the internal diameter of the support ring, the inner ring defining a cam formation for engagement of a corresponding formation on an inner link of each parallelogram linkage, the inner ring of the actuating assembly being connected to the outer ring through elongate slots in the support ring, so that the actuating assembly may be moved axially with respect to the support ring between a position in which the jaws clamp the outer surface of an elongate workpiece and a position in which the jaws are released from the outer surface of the elongate workpiece.

2. A collet assembly according to claim 1 in which the corresponding formation on the inner link comprises a roller.

3. A collet assembly according to claim 1 in which the corresponding formation on the inner link is biased into engagement with the cam formation on the inner ring.

4. A collet assembly according to claim 1 in which the cam formation on the inner ring comprises a chamfer formation on the external diameter of the inner ring.

5. A collet assembly according to claim 1 in which bifurcated bracket formations are provided at the end of the support ring, the bifurcated bracket formations having limbs extending axially and being spaced equiangularly around the support ring, the links of the parallelogram linkage being pivotally connected between the limbs of the bifurcated bracket.

6. A collet assembly according to claim 1 in which at least three jaws are mounted at equiangular locations around the support ring.

7. A collet assembly according to claim 1 in which the jaws define longitudinal inner edges said inner edges being chamfered.

8. A collet assembly according to claim 1 in which the jaws define flat inner clamping faces.

9. A collet assembly according to claim 1 in which the inner clamping faces of the jaws are lined with a hard resilient composition.

10. A bending machine including a tubular support member and a control sleeve mounted coaxially of the tubular support member, means being provided for movement of the control sleeve axially relative to the tubular control member and a collet assembly as claimed in claim 1, the support ring of the collet assembly being secured to the tubular support member and the outer ring of the actuating assembly being secured to the end of the control sleeve, means being provided for movement of the tubular support member axially, towards and away from a bending head.

11. A collet assembly according to claim 2 in which the roller is pivotally connected to an extension of the inner link on the side of the pivotal connection to the support ring remote from the pivotal connection to the jaw.

12. A collet assembly according to claim 3 in which spring means acts between the parallelogram linkage and the support ring to bias a corresponding formation on the inner link into engagement with a cam formation on the inner ring.

13. A collet assembly according to claim 6 in which five jaws are mounted at equiangular locations around the support ring.

14. A collet assembly according to claim 9 in which the inner clamping faces of the jaws are lined with a hard neoprene rubber composition.

15. A collet assembly for a bending apparatus comprising:

a support ring, the support ring at one end is connected coaxially to a tubular support member, a plurality of jaws being pivotally connected to the other end of the support ring by parallelogram linkages, the parallelogram linkages having a pair of links with one link disposed radially inwardly of the other, to permit movement of the jaws transverse to the axis of the support ring, the jaws being spaced angularly around the circumference of the support ring;

an actuating assembly being mounted coaxially of the support ring, the actuating assembly comprising an outer ring connected to a control sleeve slidably mounted on the tubular support member and an inner ring disposed on the internal diameter of the support ring, the inner ring defining a cam formation for engagement of a corresponding formation on an inner link of each parallelogram linkage, the inner ring of the actuating assembly being connected to the outer ring through elongate slots in the support ring, so that the actuating assembly is movable axially with respect to the support ring between a position in which the jaws clamp an outer surface of an elongate workpiece and a position in which the jaws are released from the outer surface of the elongate workpiece; and said collet assembly having a bore extending therethrough to facilitate receiving an end portion of the elongate workpiece and clamping of the outer surface of an intermediate portion of the elongate workpiece.

16. A collet assembly according to claim 15 in which said tubular support member has a bore extending therethrough to facilitate receiving of an end portion of the elongate workpiece.

* * * * *